US005900897A

United States Patent [19]

Sasaki

[11] Patent Number: 5,900,897

[45] Date of Patent: May 4, 1999

[54] INK CARTRIDGE

[75] Inventor: Toyonori Sasaki, Anjo, Japan

[73] Assignee: Brother Kogyo Kabushiki Kaisha, Nagoya, Japan

[21] Appl. No.: 08/871,759

[22] Filed: Jun. 9, 1997

[30] Foreign Application Priority Data

Jun. 13, 1996 [JP] Japan ..... 8-152007
Jul. 19, 1996 [JP] Japan ..... 8-190202

[51] Int. Cl.[6] ..... B41J 2/175
[52] U.S. Cl. ..... 347/86
[58] Field of Search ..... 347/85, 86, 87

[56] References Cited

U.S. PATENT DOCUMENTS 4,556,012 12/1985 Scrudato ..... 118/268
5,509,140 4/1996 Koitabashi et al. ..... 347/86

*Primary Examiner*—N. Le
*Assistant Examiner*—Michael Nghiem
*Attorney, Agent, or Firm*—Oliff & Berridge, PLC

[57] ABSTRACT

An ink cartridge having a box-shaped cartridge body the interior of which is filled with an ink holding member through an opening provided on the upper surface thereof, and a lid member for blocking the opening of the cartridge body. The lid member is structured such that the entire lower surface in contact with the ink holding member is a curved surface, and that the connecting portion between the lid member and the cartridge body forms a smooth shape when the lid member closes the cartridge body. Also, in the inner side corner portion of the ink cartridge, there is formed a pressure portion for pressing the ink holding member.

21 Claims, 8 Drawing Sheets

INK CARTRIDGE

BACKGROUND OF THE INVENTION

1. Field of the Invention

The invention relates to an ink cartridge for supplying ink to an ink jet printer which performs recording by ejecting ink droplets onto a recording medium such as a recording sheet, and more particularly to an ink cartridge having an ink holding member for holding ink within a multiplicity of pores.

2. Description of Related Art

Generally, an ink jet printer for recording on a recording sheet by ejecting ink droplets has, within the body case, an ink jet recording head; a recording device for replaceably mounting an ink cartridge thereon which contains ink for being supplied to the recording head; a conveying device for conveying a recording sheet; and a carriage device for reciprocating the recording device in accordance with the size of the recording medium conveyed by the conveying device. The conveying device is structured to rotationally drive a platen roller whose axis extends in parallel to the reciprocating direction of the recording device so as to convey the recording medium in a direction perpendicular to the reciprocating direction of the recording device. The carriage device is structured to support the carriage, on which the recording device is mounted, so as to permit it to slide on a guide rod, which extends in parallel to the platen roller's axis, and to cause the carriage to reciprocate in the axis direction of the platen roller by means of a belt tensioned around a driving pulley driven by a motor and a driven pulley.

In the recording device, such as the ink jet printer as described above, an ink cartridge is used which holds predetermined color, amount and/or type ink for supplying ink to the recording device. Also, a porous ink holding member, such as sponge and urethane foam, is placed in the ink cartridge. The urethane foam which has been widely used has an unstable ink mobility due to the capillary phenomenon because of a large variation in pore density. In order to solve this problem, the urethane foam has, to date, been compressed for use. When the urethane foam is compressed, pores having large diameters are easily compressed and the density of the pores will be averaged.

Also, it is necessary that the ink holding member is closely placed in the inner wall surface of the ink cartridge. For example, a perspective view of a hollow cartridge body used for a conventional ink cartridge is shown in FIG. 13. In FIG. 13, the cartridge body 32 is shaped like a rectangular parallelepiped with its upper portion opened, and has a round ink outlet 34 at the lower portion, its inner side corner lines 31A, 31B, 31C and 31D, and 33A, 33B, 33C and 33D being substantially orthogonal respectively.

The ink cartridge is manufactured as described below. An ink holding member 16 (see FIG. 2) shaped like a rectangular parallelepiped for holding ink therein is manufactured slightly larger than the internal space of the cartridge body 32 and the ink holding member 16 is compressed to be inserted into the cartridge body 32. Thereafter, a lid is placed on the open side, which is opposite to the ink outlet 34, and ink is poured through an ink filling port provided on the lid. The ink holding member 16 is manufactured to satisfy the condition of W2>W3, D2>D3 and H2>H3 as compared with the internal space of the cartridge body 32 (FIG. 13) in order to bring it into tight contact with the inner wall surface 35 of the cartridge body 32.

FIG. 14 is a cross-sectional view showing an ink cartridge composed of the cartridge body 32 and the ink holding member 16. The ink contained in the ink holding member 16 flows out of the ink outlet 34 due to the capillary phenomenon, and is supplied to the ink jet head through an ink passage provided within the printer.

The conventional ink cartridge has, however, had the following problem. Being larger than the internal space of the cartridge body 32, the ink holding member 16 must be inserted into the cartridge body 32 by being forcibly compressed when the ink holding member 16 is inserted into the cartridge body 32. Since a frictional force is generated between the ink holding member 16 and the cartridge body 32 at this time, the ink holding member 16 is not pressed with a tight contact with the inner wall surface 35 of the cartridge body 32, and therefore, strain occurs in the ink holding member 16. Further, in the corner portions 31A, 31B, 31C and 31D, the ink holding member 16 receives frictional forces from two adjacent planes, and since the frictional forces are not uniform, strains easily occur in the ink holding member 16 in the corner portions 31A, 31B, 31C and 31D. As a result, there are portions where the ink holding member 16 and the cartridge body 32 are not brought into tight contact, that is, gaps occur. Particularly, as shown in FIG. 14, the gaps 38 easily occur in the corner portions 31A, 31B, 31C and 31D. Since the gaps 38 thus formed are as fine as several tens of microns, it is very difficult to closely insert the ink holding member 16 into the cartridge body 32.

Further, in another type of ink cartridge, as shown in FIGS. 15 and 16, an ink holding member 51 is inserted into a hollow cartridge body 52 from an opening provided on the upper portion, and the opening is closed with a lid member 53 in the same manner as the ink cartridge shown in FIGS. 13 and 14. In addition, the cartridge body 52 is formed with an ink supply port 54 for supplying ink to the recording head, and an air conductive hole 55 for maintaining the internal space at the atmospheric pressure and making smooth the supply of ink to the recording head through the ink supply port 54.

In the case of such a structure, the ink cartridge is generally manufactured by blocking an opening with the lid member 53 for solvent welding after the cartridge body 52 is filled with ink through the opening in a state in which the ink holding member 51 has been compressed Therefore, the compression force which is exerted on the ink holding member 51 is released after the completion of solvent welding of the lid member 53, the ink holding member 51 intends to expand and return to the original state for filling the entire interior of the ink cartridge. However, the surface of the lid member 53 which is brought into contact with the ink holding member 51 is flat, and the connecting portion between the lid member 53 and the cartridge body 52 is square. Therefore, the ink holding member 51 which has expanded and returned to the original state does not align with the shape of the connecting portion, and gaps 56 (a portion of lower density than other portions) are formed between the ink holding member 51 and the lid member 53. Also, gaps 56 easily occur at the circumferential edge portion of the ink holding member 51 in contact with the cartridge body 52 because it is more difficult to expand and return to the original state than in the central portion because of the friction between the peripheral edge portion and the wall surface.

When such gaps 38, 56 as described above are formed, air will be mixed in the flow of ink within the ink holding member 16, 51, thus making it impossible to stably supply ink to the ink jet head. Therefore, mottle or blur will occur upon a printing operation and further, in the worse case, printing becomes impossible.

Also, when such gaps 38, 56 as described above are formed, ink first flows out along the gaps 38, 56 during ink distributed pouring to cause the ink holding member 16, 51 to absorb ink. And, ink is not uniformly distributed in the entire ink holding member 16, 51, but defectively distributed so that pouring easily occurs. Also, when air is fed to the printing head through the gaps 38, 56 it becomes impossible to accurately eject ink, or even to eject ink from the printing head. In addition, when the gaps 38, 56 are formed, air flows in through the gaps 38, 56, and the complete use of ink also cannot be effected well.

SUMMARY OF THE INVENTION

The invention has been achieved in order to solve the above-described problems. An object of the invention is to provide an ink cartridge capable of preventing air from getting mixed in the flow of ink and stably supplying ink to the ink jet head by forming a pressure portion for pressing the ink holding member against the inner side of the ink cartridge body.

It is another object to provide an ink cartridge capable of effecting ink distributed pouring into the ink holding member within the ink cartridge satisfactorily to consume the ink smoothly.

In order to accomplish the above-described objects, according to a first aspect of the invention, an ink cartridge supplies ink to an ink jet printer, and has an ink holding member for holding ink in a multiplicity of pores, a cartridge case for housing the ink holding member and a pressure portion for pressing the ink holding member and being formed on an inner side of the cartridge case.

In the ink cartridge of the first aspect, when the ink holding member is compressed and inserted into the ink cartridge, strain occurs in the ink holding member at the inner side of the ink cartridge. This strain causes fine gaps at the inner side corner portions of the ink cartridge. Accordingly, a portion of the ink holding member pressed by the pressure portion has higher density. When ink is poured into this higher-density portion, the ink flows in large quantities, and therefore, the fine gaps occurring in the inner side portions of the cartridge case are filled with the ink, thus pushing out the air which has existed in the gaps. Therefore, air is no longer mixed in the flow of the ink, and it becomes possible to stably supply the ink to the ink jet head, resulting in good printing when used in an ink jet printer or the like.

In the ink cartridge of the second aspect, by formation of the pressure portion which presses the ink holding member against the inner side corner portion of the ink cartridge, the contact surface between the inner side corner portion and the ink holding member is changed from line to surface, thus making it possible to certainly press the ink holding member. Accordingly, the contact portion between the ink holding member and the inner side corner portions of the ink cartridge has a higher density. When ink is poured into this higher-density portion, the ink flows in large quantities, and therefore, the fine gaps occurring in the inner side corner portions are filled with the ink, thus pushing out the air which has existed in the gaps. Therefore, air is no longer mixed in the flow of the ink, and it becomes possible to stably supply the ink to the ink jet head, resulting in good printing when used in an ink jet printer or the like.

In the third, fourth or fifth aspects of the invention, the pressure portion is an arcuate one formed in the corner portions, or is an inclined plane formed in the corner portions, the angle of which is preferably 45 degrees.

In the sixth or seventh aspect of the invention, the ink cartridge is manufactured by cutting a large foam material at right angles in such a manner that the ink holding member is shaped like a rectangular parallelepiped and has a volume 1.7 times or more the internal space of the ink cartridge in the state before incorporation into the ink cartridge.

In the ink cartridge of the above structure, since the ink holding member has a volume 1.7 times or more the internal space of the ink cartridge, the ink mobility and ink holding force can be optimized when it is mounted to the ink cartridge.

According to the eighth aspect of the invention, an ink cartridge for an ink jet printer having an ink absorption member comprised of a material having a plurality of pores and for holding ink therein and a cartridge case having an opening for housing the ink absorption member and a lid member for blocking the opening of the cartridge case, and an inclined portion formed on an inner surface of the lid member for forming a smooth surface.

In the eighth aspect of the invention, since the connecting portion between the lid member and the cartridge body forms a smooth shape when the lid member blocks the cartridge body, the shape of the ink absorption member comes to follow without difficultly even at the connecting portion.

According to the ninth aspect of the invention, the lid member is structured such that the entire inner surface of the lid member is in contact with the ink absorption member.

In the ninth aspect of the invention, since the entire inner surface of the lid member is in contact with the ink absorption member, the lid member corresponds to the shape of the ink absorption member after the lid member blocks the cartridge body, and the ink absorbing member comes to follow the lid member without difficulty.

According to the tenth aspect of the invention, the inner surface of the lid member is formed in a curved shape. In the tenth aspect of the invention, because the inner surface of the lid member is formed in a curved shape, the lid member corresponds to the shape of the ink absorption member after the lid member blocks the cartridge body, and the ink absorbing member comes to follow the lid member without difficulty.

According to the eleventh aspect of the invention, the cartridge case houses the ink absorption member in a compressed state. In the eleventh aspect of the invention, because the cartridge case houses the ink absorption member in a compressed state, the ink absorption member follows its shape without any difficulty due to expansion and return to the original state of the ink absorption member after the lid member blocks the cartridge case.

According to the twelfth aspect of the invention, an ink cartridge is partitioned into a housing chamber in which the ink absorption member is housed, and an ink chamber for storing the ink liquid.

In the twelfth aspect of the invention, the ink absorbing member housed in the housing chamber follows the shape without any difficulty at the connecting portion between the cartridge body and the lid member.

According to an ink cartridge of the first aspect, when the ink holding member is inserted into the cartridge case by means of a pressure portion formed at the inner side corner portions of the ink cartridge, a pressing force occurs at the inner side of the ink cartridge, and the ink holding member has higher density than the other portions at the corner portions.

More specifically, when ink is poured into this higher-density portion, the ink flows in large quantities and, therefore, fine gaps caused in the inner side portions are filled with the ink, thus pushing out the air which has existed in the gaps. Accordingly, air is not mixed any longer in the flow of the ink, and the ink can be stably supplied to the ink jet head, thus resulting in good printing.

According to the eighth aspect of the invention, since the inner surface of the lid member has been arranged to form a smooth shape when the lid member blocks the cartridge case as described above, the ink absorption member can follow without any difficulty even at the inner surface of the lid member, and it becomes possible to eliminate the gaps between the lid member and the cartridge case which cause defective distributed pouring and incomplete use of the ink.

According to the ninth or tenth aspect of the invention, since the lid member is structured such that the entire inner surface of the lid member is in contact with the ink absorption member, or the inner surface of the lid member is formed in a curved shape, the lid member can be simply structured such that the inner surface of the lid member forms a smooth shape.

According to the eleventh aspect of the invention, since the cartridge case houses the ink absorption member in a compressed state, the ink absorption member comes to follow the shape without any difficulty at the inner surface of the lid member due to the expansion and return operation after the ink absorption member is housed in the cartridge case.

According to the twelfth aspect of the invention, the ink cartridge is partitioned into a housing chamber in which the ink absorption member is housed, and an ink chamber for storing the ink liquid. Therefore, the volume of the ink tank can be effectively used, and not only the ink in the ink absorption member but also the ink liquid in the ink chamber can be smoothly consumed.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Hereinafter, an ink cartridge according to the preferred embodiments will be described in detail in conjunction with the drawings.

Figure 1:
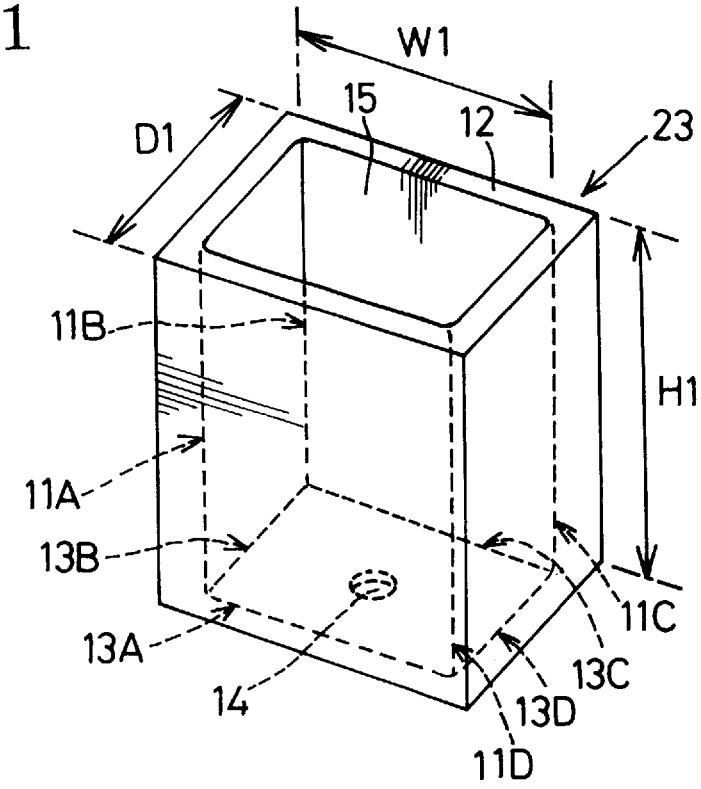
FIG. 1 is a perspective view showing a cartridge body used for an ink cartridge according to a first embodiment.

FIG. 1 is a perspective view showing a hollow cartridge body 12 used for an ink cartridge according to the first embodiment. In FIG. 1, the cartridge body 12 is shaped like a rectangular parallelepiped with the upper portion opened, has a round ink outlet 14 at the lower portion, and pressure portions 11A, 11B, 11C and 11D, and 13A, 13B, 13C and 13D formed in the inner side corner portions. The pressure portions 11A, 11B, 11C and 11D, and 13A, 13B, 13C and 13D are arcuate. The pore diameter of the ink holding member in the corner portion is determined by the radius of the arc. A pore diameter of 100 $\mu$m or more deteriorates the ink mobility, thus causing ink to easily collect. Accordingly, in order to collect ink in the corner portion, it is necessary to set the pore diameter of the ink holding member to 100 $\mu$m or less.

Figure 2:
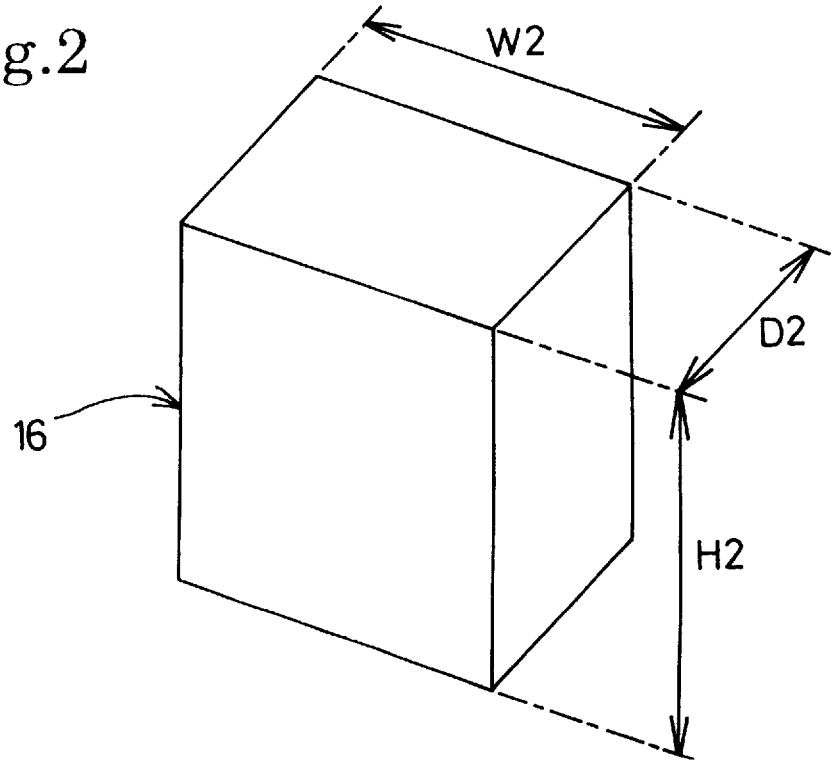
FIG. 2 is a perspective view showing an ink holding member before placement within the ink cartridge.

As shown in FIG. 2, the ink holding member 16 is shaped like a rectangular parallelepiped manufactured by cutting a large foam material at right angles. As the foam material, urethane foam is generally used. The size of the ink holding member 16 is so manufactured as to satisfy relationships of $W1<W2$, $D1<D2$ and $H1<H2$ as compared with the cartridge body 12. For example sizes of the ink holding member 16, for example, W1=35 mm, W2=36 mm, D1=9 mm, D2=15 mm, H1=47 mm and H2=53 mm. The ink holding member 16 has an average pore diameter of about 350 $\mu$m in a natural state, and has a volume 1.7 times or more the internal space of the cartridge body 12.

This is because the ink holding member 16 is brought into tight contact with the inner side corner portions and the inner wall surfaces 15 of the cartridge body 12, and is further compressed for use so that the pore density of the ink holding member 16 is averaged.

Figure 3:
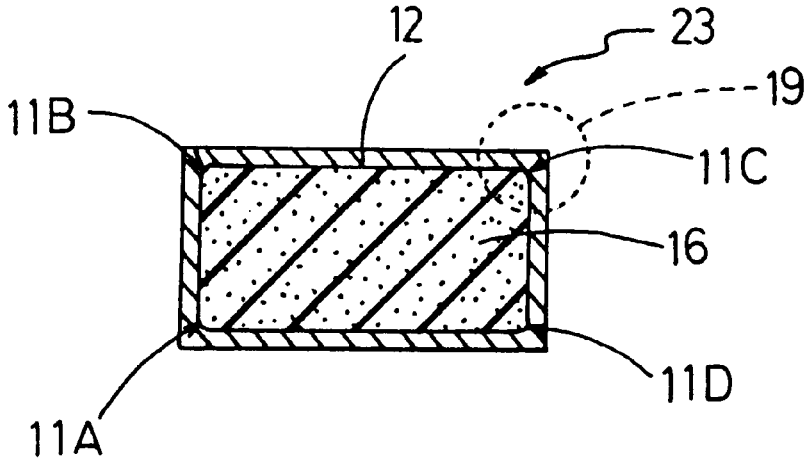
FIG. 3 is a cross-sectional view showing the ink cartridge according to the first embodiment.
Figure 4:
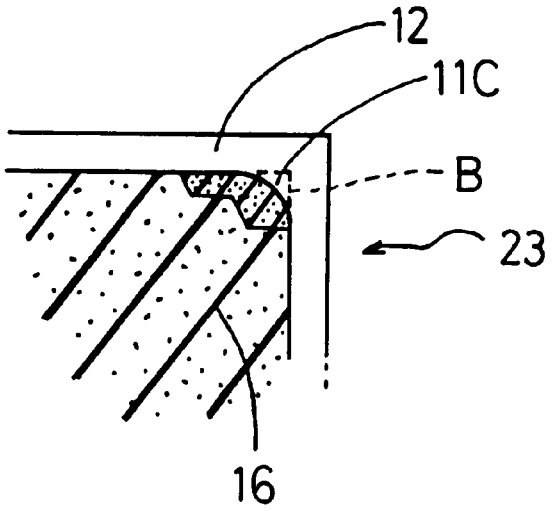
FIG. 4 is an enlarged view showing a corner portion shown in FIG. 3.

Next, the cross-sectional view of the ink cartridge 23 according to the first embodiment is shown in FIG. 3, and an enlarged view for one corner portion 19 among a plurality of corner portions is shown in FIG. 4. The ink cartridge 23 is composed of the cartridge body 12 and the ink holding member 16, and is manufactured by compressing and inserting the ink holding member 16 into the cartridge body 12, and thereafter placing the lid on the upper portion to pour ink.

As shown in FIG. 4, the inner side corner portion of the ink cartridge 23 is formed with an arcuate pressure portion 11C inside such a vertical corner portion as indicated by a dotted line B in FIG. 4. The pressure portion 11C presses the ink holding member 16, thus causing the pore diameter to become smaller in the corner portion 19. In other words, the ink holding member 16 is pressed by the pressure portion 11*c* to thereby increase the density higher at the corner portion 19.

As shown in FIGS. 1 and 3, the cartridge body 12 is provided with pressure portions 11A, 11B, 11C and 11D, and 13A, 13B, 13C and 13D. The radii (R) of those pressure portions 11A, 11B, 11C and 11D, and 13A, 13B, 13C and 13D are determined by the hardness and the coefficient of friction of the foam in the ink holding member 16. For example, in case where the foam in the ink holding member 16 is hard, R of the pressure portion is preferably small, while in case where the foam in the ink holding member 16 is soft, the R of the pressure portion is preferably large. For example, if the ink holding member 16 is hard, R of the pressure portion is preferably R=0.3 to 0.5 mm. If the ink holding member 16 is soft, R of the pressure portion is R=1.0 mm or more, or preferably 2 mm or more.

Figure 5:
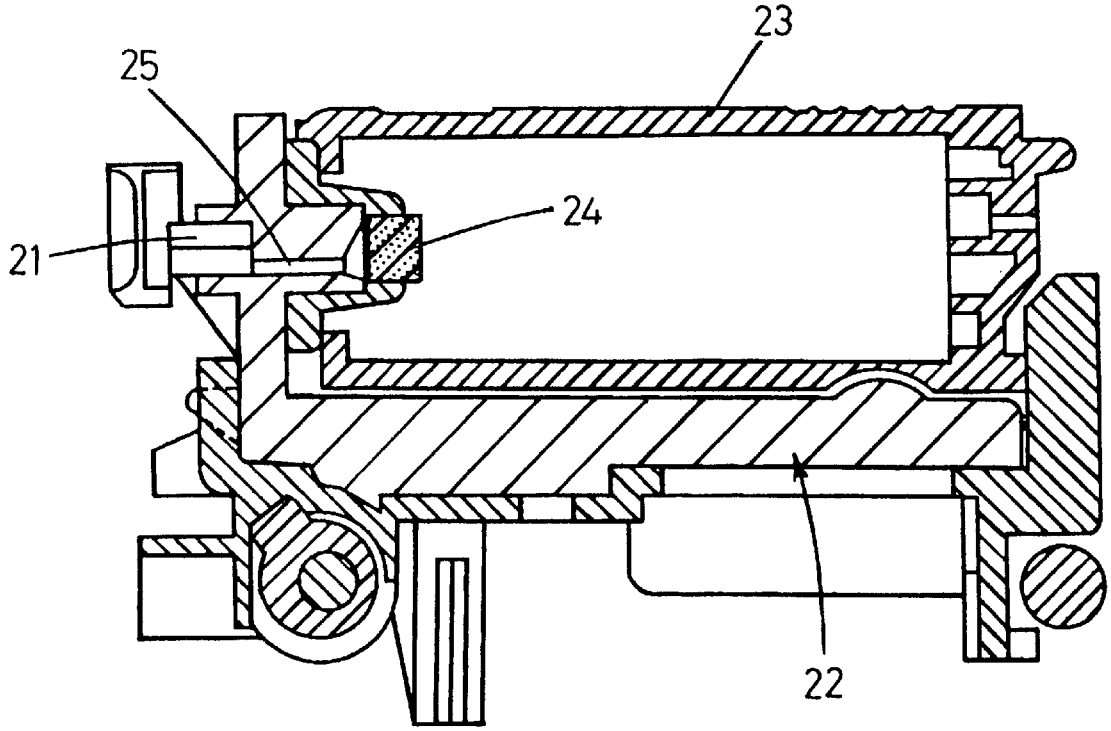
FIG. 5 is a partial cross-sectional view showing an ink jet device.

Further, the partial cross-sectional view of an ink jet device in which this ink cartridge 23 is used is shown in FIG. 5. The ink jet device is composed of a ink jet head 21, a head holder 22, and an ink cartridge 23. The ink held in the ink cartridge 23 passes through an ink outlet 14 to moisten the porous member 24, and is supplied to the ink jet head 21 through the ink passage 25.

As shown in FIGS. 1 and 3, pressure portions 11A, 11B, 11C and 11D, and 13A, 13B, 13C and 13D are formed in the inner side corner portions of the cartridge body 12. Therefore, the contact surface between the cartridge body 12 and the ink holding member 16 is changed from a line to a surface at the corner portion, and therefore, the ink holding member 16 can be reliably pressed.

In other words, when the ink holding member 16 is inserted into the cartridge body 12, the pressure portions 11A, 11B, 11C and 11D, and 13A, 13B, 13C and 13D cause pressing forces to the inner side corner portions of the cartridge body 12. Therefore, as shown in FIG. 4, the ink holding member 16 has higher density at the corner portion than other portions. Accordingly, when ink is poured, a large quantity of ink flow into near the corner portions having higher density in the ink holding member 16. This fills the fine gaps, with ink, which are caused when the ink holding member is distorted at the corner portion, thus pushing out the air which has existed in these gaps.

As described above in detail, according to an ink cartridge of the first embodiment, the pressure portion for pressing the ink holding member has been formed at the inner side corner portion of the ink cartridge, whereby the contact portion between the ink holding member 16 and the inner side corner portion of the ink cartridge has higher density. Therefore, when ink is poured, a large quantity of ink flows into the portion having higher density to thereby fill the fine gaps with the ink, which occur at the inner side corner portion, thus pushing out the air which has existed in these gaps. As a result, air will not be mixed in the flow of the ink within the ink cartridge, making it possible to stably supply the ink to the ink jet head for good printing.

Figure 6:
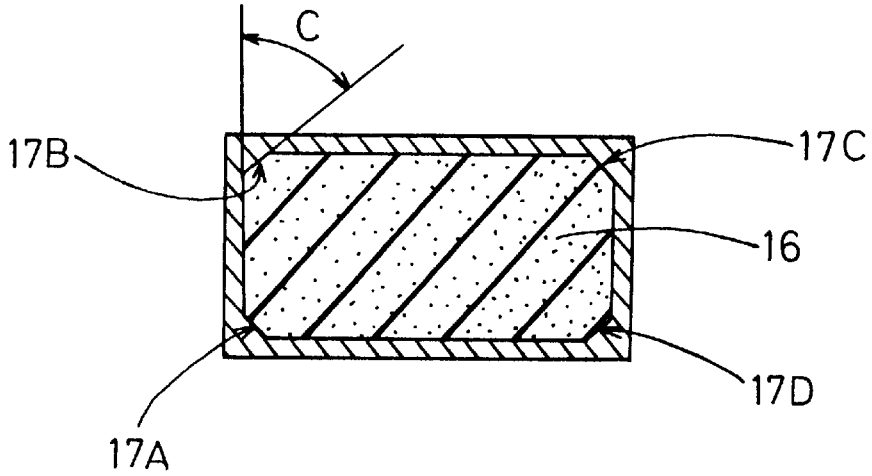
FIG. 6 is a cross-sectional view showing an ink cartridge according to a second embodiment.

Next, a description will be made of the ink cartridge according to the second embodiment referring to FIG. 6.

In the ink cartridge according to the second embodiment, the pressure portions 17A, 17B, 17C and 17D for pressing the ink holding member 16 form inclined planes. The inclined planes incline by an angle C shown in FIG. 6 with respect to the side wall of the cartridge body 12. This angle C is determined by the hardness and coefficient of friction of the ink holding member 16. For example, this angle C is preferably 45 degrees.

Even if the shape of the pressure portions 17A, 17B, 17C and 17D is changed from the arcuate shape to the inclined surface, there is formed the pressure portion which presses the ink holding member against the inner side corner portion of the ink cartridge, and therefore, the contact portion between the ink holding member and the inner side corner portion of the ink cartridge has higher density. Accordingly, when ink is poured, a large quantity of ink flows into the portion having higher density to thereby fill the fine gaps, with the ink, which occur at the inner side corner portion, thus pushing out the air which has previously existed in these gaps. As a result, air does not get mixed in the flow of the ink within the ink cartridge, making it possible to stably supply the ink to the ink jet head for good printing. Further, in the manufacture of a mold used for manufacturing the cartridge body, it is easier when the shape of the pressure portion is the inclined surface than the arcuate shape, and therefore the manufacturing cost can be reduced.

Figure 7:
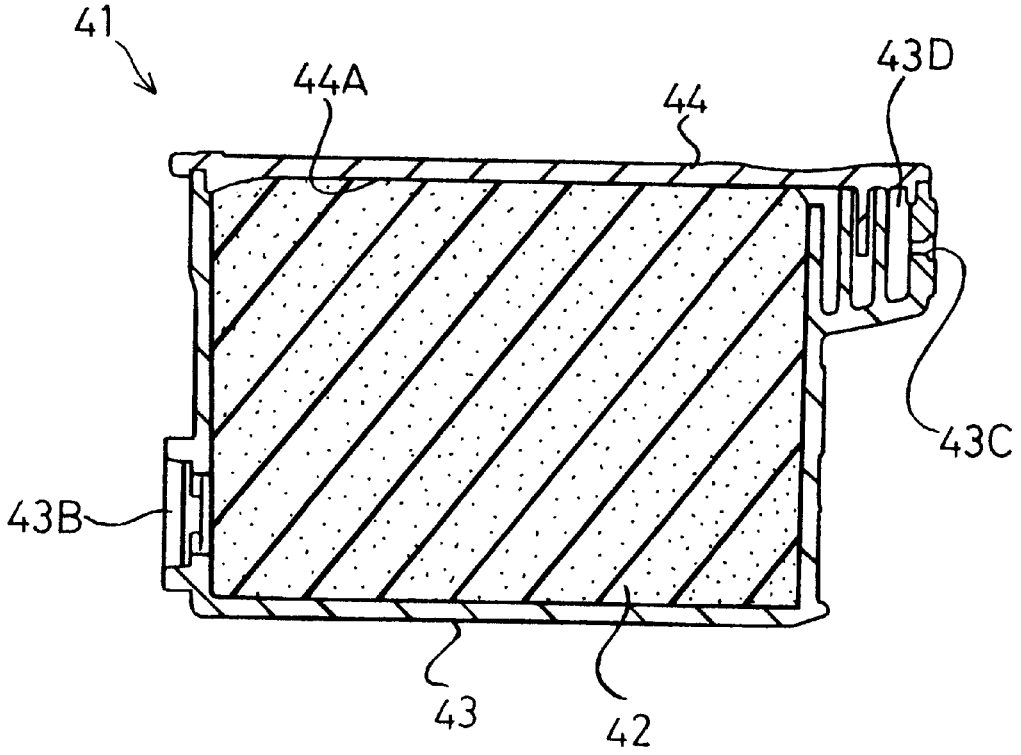
FIG. 7 is a longitudinal cross-sectional view showing an ink cartridge according to a third embodiment.
Figure 8:
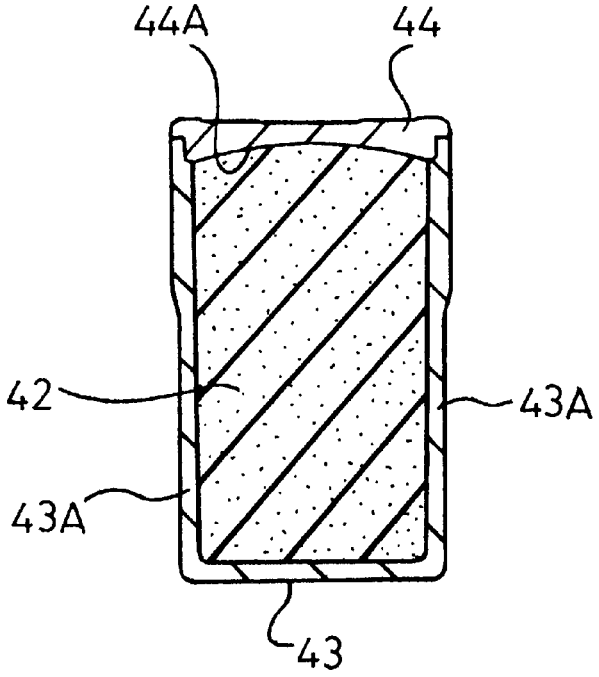
FIG. 8 is a transverse cross-sectional view showing an ink cartridge according to the third embodiment.

FIGS. 7 and 8 show an ink cartridge for an ink jet printer. In FIGS. 7 and 8, the ink cartridge 41 has a box-shaped cartridge body 43 in which an ink holding member 42 has been filled from the opening provided on one plane (upper surface) to the interior in a compressed state, and a lid member 44 blocks the opening of the cartridge body 43. In the ink holding member 42, deaerated ink has been immersed.

On one side of the cartridge body 43, an ink supply port 43B for supplying ink to the recording head (not shown) is formed, and on the other side thereof, an air conductive hole 43C is formed. On the side on which the air conductive hole 43C is formed, there is formed an air buffer 43D for preventing evaporation of the ink through the air conductive hole 43C.

The lid member 44 is structured such that an entire plane 44A (lower surface) in contact with the ink holding member 42 forms a curved surface as shown in FIGS. 7 and 8. As shown in FIG. 7, the lower surface 44A of the lid member 44 is curved toward the ink supplying hole 43B at the end portion of the lid member 44 on the side of the ink supplying hole 43B. Further, as shown in FIG. 8, the lower surface 44A of the lid member 44 is curved toward both side walls 43A of the cartridge body 43. Such a shape of the lid member 44 causes the connecting portion between the lid member 44 and the cartridge body 43 to form a smooth shape when the lid member 44 closes the cartridge body 43.

By such a structure as described above, the connecting portion between the lid member 44 and the cartridge body 43 forms a smooth shape when the lid member 44 closes the cartridge body 43, and therefore, the ink holding member 42 can follow without difficulty even at the connecting portion.

When the cartridge body 43 is filled with the ink holding member 42 in a compressed state, the plane 44A (curved surface) of the lid member 44 corresponds to the shape of the ink holding member 42 which is supposed to be finally formed by means of the expansion and return after the cartridge body 43 is closed by the lid member 44. Therefore, the ink holding member 42 after the expansion and return can follow the connecting portion between the cartridge body 43 and the lid member 44 and the plane 44A of the lid member 44 without any difficulty. This eliminates the gaps formed between the ink holding member 42 and the lid member 44 which cause defective distributed pouring and incomplete use of ink. Accordingly, it becomes possible to effect distributed pouring satisfactorily, and the ink can be smoothly consumed In the third embodiment, the description has been made of the example in which the ink cartridge is structured such that the entire cartridge body 43 is filled with the ink holding member 42 to contain the ink, but the invention is not limited thereto, but is also applicable to an ink cartridge which is partitioned into a housing chamber in which the ink holding member 42 is housed, and an ink chamber for storing ink liquid therein.

Figure 9:
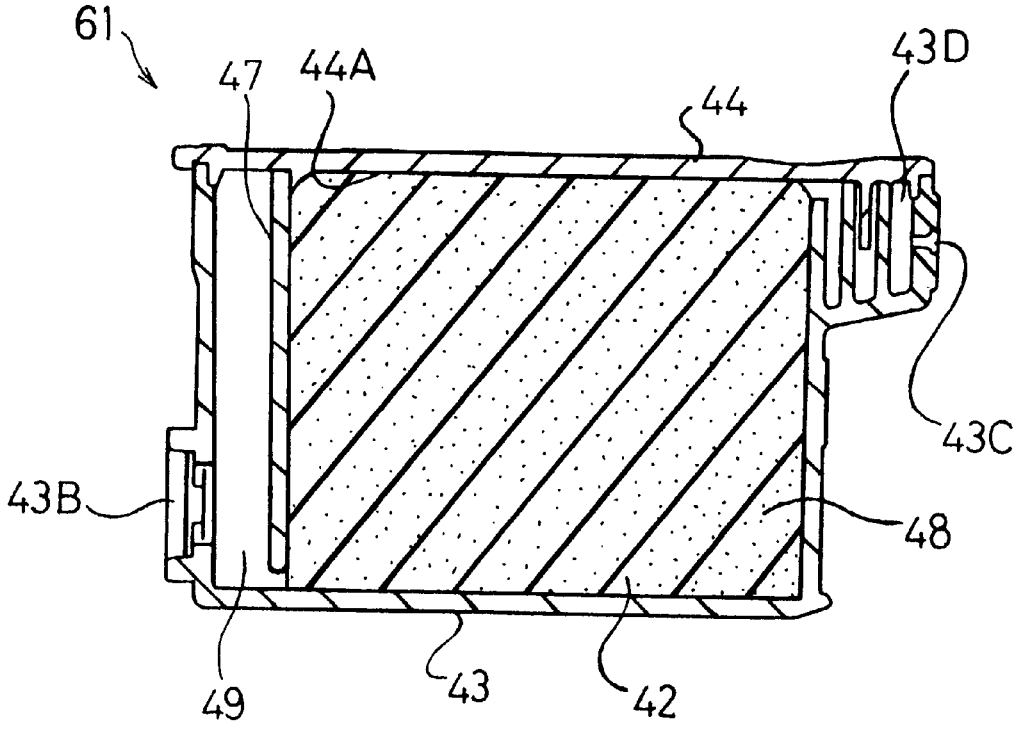
FIG. 9 is a cross-sectional view showing an ink cartridge according to a fourth embodiment.
Figure 10:
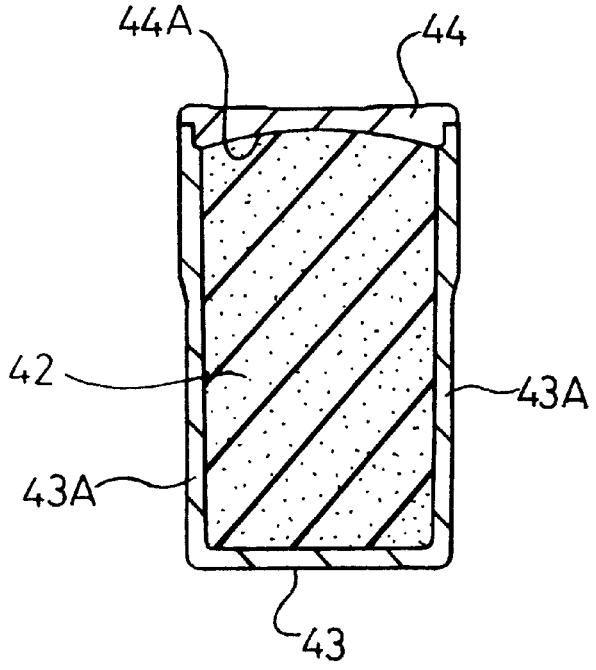
FIG. 10 is a transverse cross-sectional view showing an ink cartridge according to the fourth embodiment.

In the ink cartridge 61 of the fourth embodiment shown in FIGS. 9 and 10, the interior of the ink cartridge 41 is partitioned by a partition wall 47 into two chambers of a housing chamber 48 and an ink chamber 49. In the ink cartridge 71 of the fifth embodiment, shown in FIGS. 11 and 12, the layout of the housing chamber 48 and the ink chamber 49 is opposite to that of the ink cartridge 61 of the fourth embodiment.

The cartridge for the fourth or fifth embodiment is capable of containing more ink by the quantity corresponding to the ink chamber 49 containing no foam, but only ink, than the cartridge for the third embodiment although all embodiments have the same size cartridge body 43. Therefore, the volume of the cartridge body 43 can be effectively used.

Figure 11:
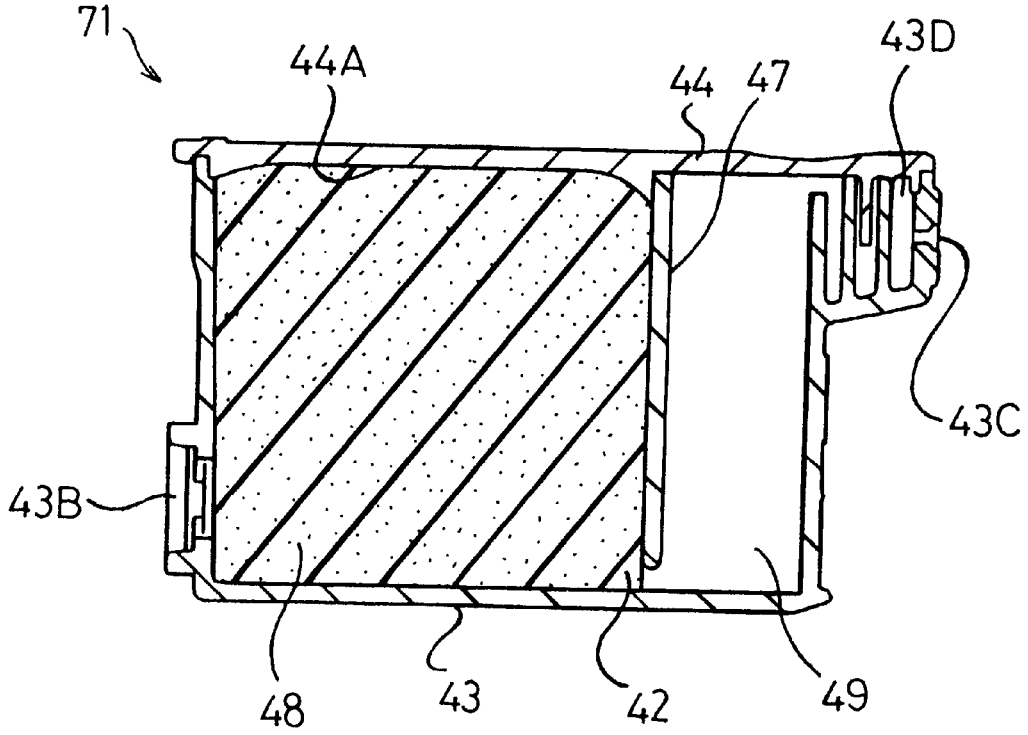
FIG. 11 is a cross-sectional view showing an ink cartridge according to a fifth embodiment.
Figure 12:
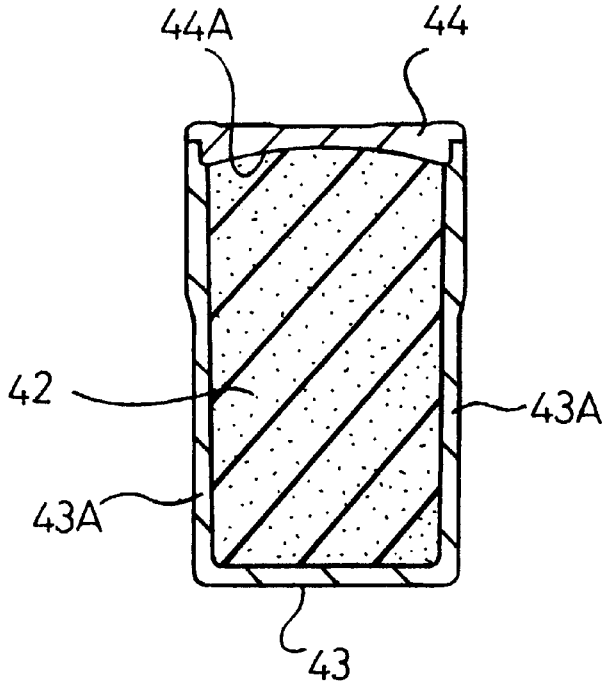
FIG. 12 is a transverse cross-sectional view showing an ink cartridge according to the fifth embodiment.
Figure 13:
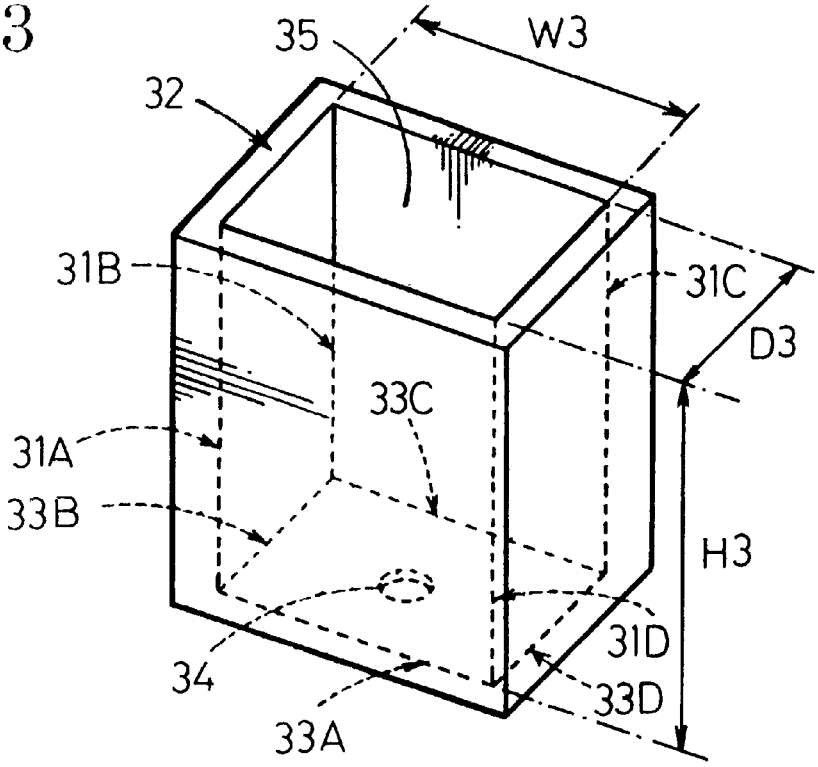
PRIOR ART Fig.13
FIG. 13 is a perspective view showing a cartridge body used for a conventional ink cartridge.
Figure 14:
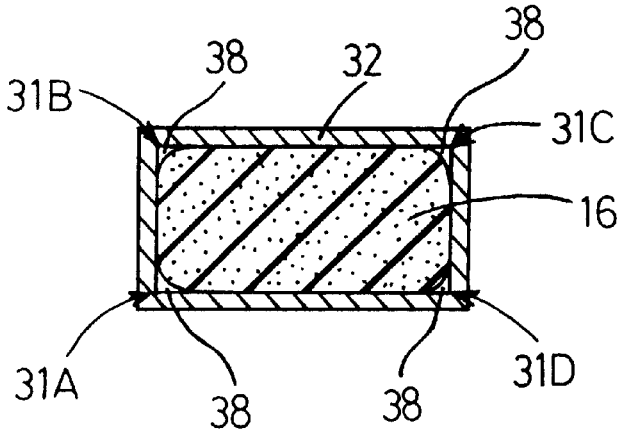
Fig.14 PRIOR ART
FIG. 14 is a cross-sectional view showing the conventional ink-cartridge.
Figure 15:
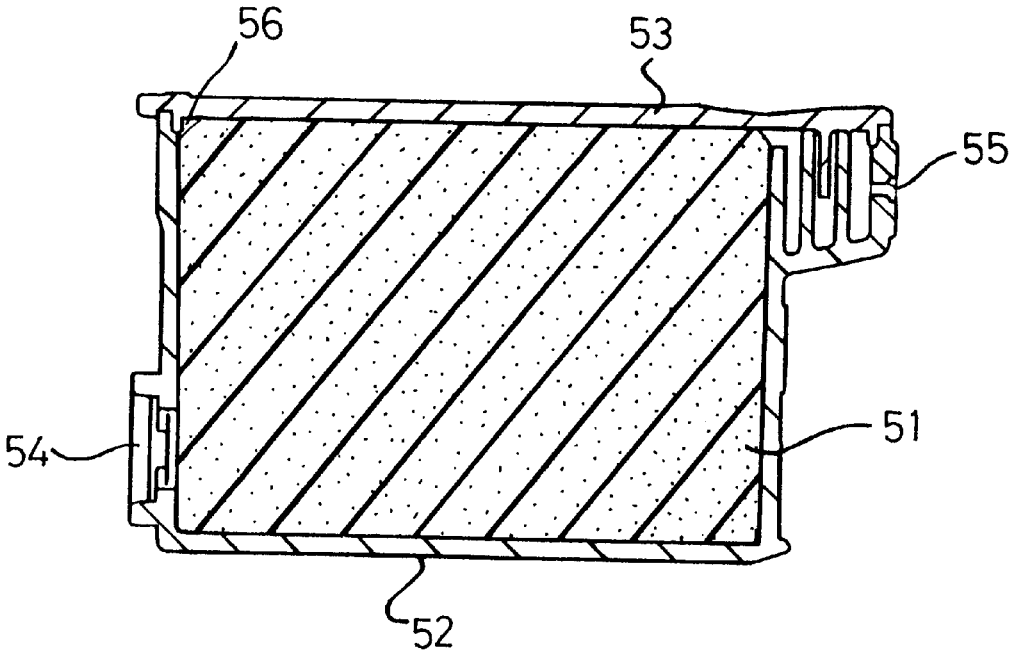
Fig.15 PRIOR ART
FIG. 15 is a longitudinal cross-sectional view showing the conventional ink cartridge.
Figure 16:
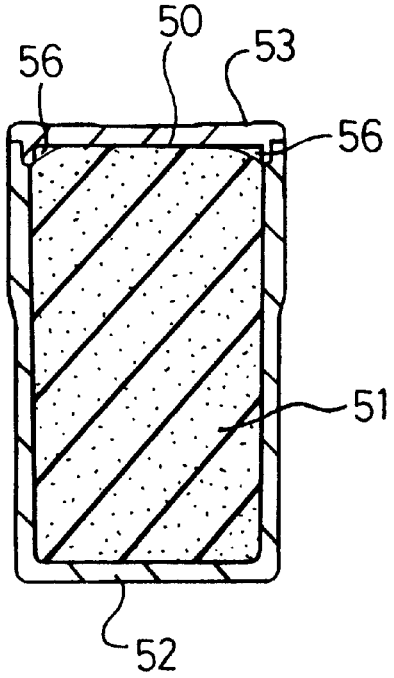
Fig.16 PRIOR ART
FIG. 16 is a transverse cross-sectional view showing the conventional ink cartridge.

In the cartridge of the fourth or fifth embodiment, as shown in FIGS. 9 to 12, the lower surface 44A of the lid member 44 is curved toward the ink supplying hole 43B at the end portion of the lid member 44 on the side of the ink supplying hole 43B. The lower surface of the lid member 44 is also curved at the end portion of the lid member 44 on the side of the partition wall 47 as shown in FIG. 11. Further, the lower surface 44A of the lid member 44 is curved toward both side walls 43A of the cartridge body 43. Such a shape of the lid member 44 causes the connecting portion between the housing chamber 48 in which the ink holding member 42 is housed and the lid member 44 to form a smooth shape when the lid member 44 closes the cartridge body 43.

Thus, the ink holding member 42 can follow the inner surface without difficulty even at the connecting portion, and such gaps as described above are eliminated between the lid member 44 and the cartridge body 43. Accordingly, good ink distributed pouring can be effected in the same manner as in the third embodiment. In addition, since the flow of ink can be equalized between the ink chamber 49 and the housing chamber 48, the ink which cannot be used up does not remain in either chamber above, but complete use of the ink in both the housing chamber and the ink chamber is improved.

In this respect, the shape of the ink cartridge is of no particular consideration in the invention, and is applicable if the lid member is formed with neither air conductive hole nor air buffer as described above.

In addition, in an ink cartridge having both such a pressure portion as described in the first or second embodiment and such curved shape of the lid member as described in the third, fourth or fifth embodiments, further effects can be obtained.

In this respect, the invention is not restricted to the above-described embodiments, but various improvements and deformations are possible so long as these are not departed from the subject matter of the invention as a matter of course.

For example, in the first and second embodiments described above, the description has been made of the examples in which the shape of the pressure portion is arcuate shape and an inclined surface, but the pressure portion may be also formed into a shape of multiple planes. Also, for the foam material used for the ink holding member, any material which has a multiplicity of pores and an average uniform pore density upon compression can be used.

What is claimed is:

1. An ink cartridge for supplying ink to an ink jet printer, comprising:

an ink holding member having a multiplicity of pores for holding ink in the multiplicity of pores;

a cartridge case for housing said ink holding member; and a pressure portion for pressing said ink holding member formed on an inner side of said cartridge case, provided at an inner side corner portion of said cartridge case.

2. The ink cartridge according to claim 1, wherein said pressure portion is an arcuate portion formed at said corner portion.

3. The ink cartridge according to claim 2, wherein the arcuate portion is an arc having a radius of at least 0.3 mm.

4. The ink cartridge according to claim 1, wherein said pressure portion is an inclined surface formed on said corner portion.

5. The ink cartridge according to claim 4, wherein the angle of said inclined surface is 45 degrees.

6. The ink cartridge according to claim 1, wherein said ink holding member is shaped like a rectangular parallelepiped and has a volume 1.7 times or more an internal space of said cartridge case in a state before said ink holding member is housed in said cartridge case.

7. The ink cartridge according to claim 6, wherein said ink holding member is manufactured by cutting a large foam material at right angles.

8. The ink cartridge according to claim 1, wherein the cartridge case comprises a cover and a body, a further pressure portion provided where the cover joins the body.

9. An ink cartridge for an ink jet printer, comprising:

an ink absorption member comprised of a material having a plurality of pores and for holding ink therein;

a cartridge case having an opening and for housing said ink absorption member;

a lid member for blocking the opening of said cartridge case; and an inclined portion to provide a pressure portion formed on an inner surface of said lid member for forming a smooth surface with the cartridge case when blocking the opening and in substantially continuous contact with the ink absorption member.

10. The ink cartridge according to claim 9, wherein said lid member is structured such that the inner surface of said lid member is in contact with said ink absorption member.

11. The ink cartridge according to claim 9, wherein said inner surface of said lid member is formed in a concave curved shape.

12. The ink cartridge according to claim 9, wherein said cartridge case houses said ink absorption member in a compressed state.

13. The ink cartridge according to claim 9, further comprising a partition partitioning said cartridge case into a housing chamber in which said ink absorption member is housed, and an ink chamber for storing ink liquid.

14. An ink cartridge for use with a printing device, comprising:

a cartridge body having four side walls with interior corners between connected adjacent side walls of the four side walls, a base wall connected to one end of each side wall, the four side walls and the base wall defining an ink storage chamber;

an ink holding member insertably mounted in the ink storage chamber; and a cover for attachment to opposite ends of the four side walls from the base wall to enclose the ink storage chamber with the ink holding member therein and forming a plurality of interior corners comprising an interior corner formed with each side wall, at least one interior corner of the interior corners connecting the adjacent side walls and the interior corners between the cover and the four side walls modified to provide pressure portions to substantially engage the ink holding member throughout the at least one corner.

15. The ink cartridge according to claim 14, wherein the pressure portions are arcuate portions.

16. The ink cartridge according to claim 15, wherein the arcuate portions have a radius of arc of at least 0.3 mm.

17. The ink cartridge according to claim 14, wherein the pressure portion is an inclined surface extending from one side wall to an adjacent side wall.

18. The ink cartridge according to claim 17, wherein the inclined surface is at a 45 degree angle to both the one side wall and the adjacent side wall.

19. The ink cartridge according to claim 14, wherein the ink holding member is made of a highly porous resilient substance and has exterior dimensions greater than interior dimensions of the ink storage chamber so the ink holding member is compressed when mounted in the ink storage chamber.

20. The ink cartridge according to claim 14, wherein the cover has a curved inner surface for contacting the ink holding member when attached to the opposite ends of the four side walls.

21. The ink cartridge according to claim 19, wherein the ink holding member has a volume at least 1.7 times a volume of the ink storage chamber.

* * * * *